US010265720B2

(12) United States Patent
Baker

(10) Patent No.: US 10,265,720 B2
(45) Date of Patent: Apr. 23, 2019

(54) DEVICE AND METHOD FOR COATING MATERIAL WITH RESIN AND SUBSEQUENTLY LAYING THE MATERIAL SATURATED WITH THE RESIN ONTO A SURFACE

(71) Applicant: SIKA TECHNOLOGY AG, Baar (CH)

(72) Inventor: Bruce Baker, East Brunswick, NJ (US)

(73) Assignee: SIKA TECHNOLOGY AG, Baar (CH)

( * ) Notice: Subject to any disclaimer, the term of this patent is extended or adjusted under 35 U.S.C. 154(b) by 0 days.

(21) Appl. No.: 15/841,746

(22) Filed: Dec. 14, 2017

(65) Prior Publication Data

US 2018/0161804 A1 Jun. 14, 2018

(30) Foreign Application Priority Data

Dec. 14, 2016 (EP) ..... 16204177

(51) Int. Cl.

| | |
|---|---|
| ***B05C 11/02*** | (2006.01) |
| ***E04D 15/06*** | (2006.01) |
| ***B05C 3/12*** | (2006.01) |
| ***B05C 3/08*** | (2006.01) |
| ***H01B 13/32*** | (2006.01) |
| ***B05C 11/10*** | (2006.01) |
| ***E04D 15/04*** | (2006.01) |
| ***B05C 9/08*** | (2006.01) |
| ***B05C 9/04*** | (2006.01) |

(52) U.S. Cl.

CPC ..... *B05C 11/025* (2013.01); *B05C 3/08* (2013.01); *B05C 3/125* (2013.01); *B05C 11/1047* (2013.01); *E04D 15/06* (2013.01); *H01B 13/32* (2013.01); *B05C 9/04* (2013.01); *B05C 9/08* (2013.01); *E04D 15/04* (2013.01); *E04D 2015/042* (2013.01)

(58) Field of Classification Search

USPC ..... 156/71, 307.1, 307.3, 307.5, 307.7; 118/404, 405, 413, 429

See application file for complete search history.

(56) References Cited

U.S. PATENT DOCUMENTS

| | | | | |
|---|---|---|---|---|
| 1,306,650 A | | 6/1919 | Weinheim | |
| 2,766,721 A | * | 10/1956 | Paquette ..... | H01M 4/04 118/405 |
| 3,148,104 A | | 9/1964 | Rapp | |

(Continued)

FOREIGN PATENT DOCUMENTS

| | | |
|---|---|---|
| DE | 202005000952 U1 | 7/2005 |
| WO | 2015-063196 A1 | 5/2015 |

OTHER PUBLICATIONS

Mar. 7, 2017 Search Report issued in European Patent Application No. 16204177.6.

*Primary Examiner* — Sing P Chan
(74) *Attorney, Agent, or Firm* — Oliff PLC

(57) ABSTRACT

A device for coating material with resin and subsequently laying the material saturated with the resin onto a surface, the device comprising a vessel for retaining the resin, the vessel having a slot sized and configured so that the material is passable through the slot after being coated with resin retained in the vessel, and a first and a second roller being arranged on either side of the slot or behind the slot.

15 Claims, 5 Drawing Sheets

(56) References Cited

U.S. PATENT DOCUMENTS

| | | | | |
|---|---|---|---|---|
| 5,785,270 | A * | 7/1998 | Buchko | B65H 23/06<br>242/396.8 |
| 6,527,217 | B1 * | 3/2003 | Lyons | A01K 97/26<br>242/129.53 |

* cited by examiner

DEVICE AND METHOD FOR COATING MATERIAL WITH RESIN AND SUBSEQUENTLY LAYING THE MATERIAL SATURATED WITH THE RESIN ONTO A SURFACE

TECHNICAL FIELD

The present invention relates to a device and a method for coating material with resin and subsequently laying the material saturated with the resin onto a surface.

TECHNICAL BACKGROUND

U.S. Pat. No. 3,148,105 discloses an apparatus for applying roofing materials. A sheet of webbing passes downward through a volume of asphalt in a container from a first roller to the bottom of a middle roller. The saturated material exits the container in an open top portion of the container. In a distance from the container, the material passes a space between a front roller and a scraper blade. In total the apparatus of U.S. Pat. No. 3,148,104 seems to be rather complex.

DE 20 2005 000952 U1 shows a similar concept as U.S. Pat. No. 3,148,104. DE 20 2005 000952 U1 discloses a method of laying saturated sheets on a roof or similar surface. The saturated sheets exit a container in an upper open region. After exiting the container, the sheet passes a pivotal rod. Also the structure of DE 20 2005 000952 U1 seems to be rather complex.

Within another technical field, U.S. Pat. No. 1,306,650 A discloses a process and apparatus for impregnating a strip of fragile body fabric with a character converting dope. However, U.S. Pat. No. 1,306,650 A is configured for another purpose and not suitable for "coating material with resin and subsequently laying the material saturated with the resin onto a surface". In particular, U.S. Pat. No. 1,306,650 A is not particularly relevant for the context of the present invention.

WO 2015/063196 discloses a device and a method for saturating material with resin and subsequently laying the saturated material onto a surface. The device includes a frame and a vessel for retaining the resin attached to the frame. The vessel has a slot sized and configured so that material is passable through the slot after being coated with resin retained in the vessel. A first guide member is positioned adjacent the slot and a second guide member is positioned adjacent the slot and is spaced apart from the first guide member to define a passageway between the first and second guide members. The passageway is sized and configured for the material to be passed through the passageway and out of the device for laying on the surface. In this regard, there seems to be room for further improvement concerning smoothness and reliability of the process.

SUMMARY

It is an object of the present invention to propose a device and a method for coating material with resin and subsequently laying the material saturated with the resin onto a surface which allows a reliable and simple regulation of a thickness of the material saturated with the resin.

According to a first aspect of the present invention, a device for coating material with resin and subsequently laying the material saturated with the resin onto a surface comprises a vessel for retaining the resin, the vessel having a slot sized and configured so that material is passable through the slot after being coated with resin retained in the vessel, and a first and a second roller being arranged on either side of the slot or behind the slot (in a moving direction of the unrolled material).

A core idea of the invention is to provide the two (first and second) rollers being arranged on either side of the slot or behind the slot (on an outer side of the vessel). Thereby, the saturated fabric can be simply and reliably guided onto the substrate surface. The (direct) travel path of the reinforcing fabric from the rollers to the substrate surface minimises deformation of the fabric. Moreover, the (minimal) distance from the underside of the first and second rollers (bottom rollers) to the substrate surface minimises air entrapment underneath the membrane and minimises the need for manually finishing. In particular, the first and second rollers (bottom rollers) can be positioned to minimise drag on the reinforcing fabric. The (first and second) rollers may define the slot and/or may be the parts of the device with which the material saturated with resin is last in contact when being laid onto the surface (i.e. in particular the parts of the device from which the material saturated with resin finally leaves the device). According to the invention, a fast, reliable coating of the material with resin and subsequently laying the material saturated with the resin onto a surface is achieved. The thickness of the material laid onto the surface is comparatively consistent. In particular, a drag on the reinforcing material is minimised.

The slot is preferably arranged within a wall, in particular bottom (wall) of the vessel. In embodiments, the slot may be provided in the lowest 80% preferably lowest 50%, further preferably lowest 20% of the vessel (in a configuration where the device can be used). Alternatively or in addition, the slot may be arranged below a liquid surface of the liquid in the vessel (during use).

The device may comprise a distance adjustment mechanism for adjusting a distance between the first and second rollers and/or a slot adjusting mechanism for adjusting the width of the slot, in particular by converging or diverging the rollers with respect to each other. The distance adjustment mechanism and the slot adjustment mechanism may be provided by the same structure or different (at least partially different) structures. In particular, if the two rollers define the slot, the distance adjustment mechanism and the slot adjustment mechanism may be identical (provided by one and the same structure). In such a case, the thickness of the material saturated with the resin can be reliably regulated. A (direct) travel path of the reinforcing fabric from the rollers to the substrate surface may minimise deformation of the fabric. A (minimal) distance from the underside of first and second rollers (bottom rollers) to the substrate surface may minimise air entrapment underneath the material saturated with the resin and may minimise that need for manual finishing. Moreover, uncontrolled resin leakage through the slot may be avoided.

In general, the rollers may be supported on the device (e.g. on the frame and/or the vessel) such that they may roll around their respective centre axis.

At least one of the rollers may be rotatably mounted on a frame of the device and/or on the vessel, wherein converging and/or diverging of the rollers is preferably performed by rotation of the only one or one of the several rotatable rollers. In this context, "rotatably mounted" means that the rollers are mounted such that they may rotate (pivot) around an axis which is offset from a central axis of the rollers. For example, the corresponding roller may be supported by at least one corresponding supporting structure (e.g. at least on supporting arm), wherein the supporting structure may be rotated. In particular, the rotation (pivoting) in this context does not mean a rolling motion of the first and/or second rollers. In an alternative, the rollers may be moveably mounted on the device (e.g. the frame and/or the vessel) so that they can be converged or diverged from each other by an (at least partially) translational movement. In any event, movement (pivoting) of the rollers allows a simple adjustment of the thickness of the material saturated with resin. This further improves the performance of the device.

The distance adjusting mechanism and/or the slot adjustment mechanism may comprise a handle and/or a cable. The cable may be pullable and/or pushable by the handle for adjusting the width of the slot. Moreover, one or more spring member(s) may be provided which may support adjustment of a distance between the first and second rollers and/or the width of the slot, respectively. In this regard, a simple and convenient actuation of the respective adjustment mechanism can be achieved.

Preferably, a first guide member, in particular a first lamella or first vane or first (elongated) plate, adjacent to the first roller for guiding the material saturated with the resin and/or for sealing the first roller with respect to a vessel main body, maybe provided. Alternatively, or in addition a second guide member, in particular second lamella or second vane or second (elongated) plate, adjacent to the second roller, for guiding the material saturated with the resin and/or for sealing the second roller with respect to the vessel main body, may be provided.

The first and/or second guide member may be arranged and mounted so that parts of it are (at least slightly) pressed against the first or second roller, respectively. The first and/or second guide member may extend at least substantially in parallel with the first and/or second roller, respectively. The first and/or second guide member may be formed of a resilient material. The first and/or second guide member may be formed of plastic, in particular polymer material or comprising such material. In any event, resin leakage can be reduced or fully avoided. The first and/or second guide member may be mounted (as separate part, optionally with a different material) onto the main body of the vessel (e.g. by a form-fit optionally comprising a projection and/or recess).

The device may comprise at least one stopping member arranged at least partially between the rollers for stopping a sideward flow of resin located between the rollers. The stopping member may be arranged at or adjacent to at least one end of the rollers. In particular, the stopping member may be arranged within a portion of the rollers which defines less than 20% or less than 10% of an overall (axial) length measured from one of the ends (axial ends) of the rollers. In any event, leakage of resin can be further reduced (or fully avoided) with simple means.

The rollers may comprise a metal, in particular steel, component, preferably as a core member and/or a tubular and/or cylindrical member. Alternatively or in addition, the rollers may comprise a plastic, in particular polymer, component, preferably a plastic, in particular polymer, coating. In this regard, rigid rollers which allow moving the material saturated with resin through the vessel with minimised drag may be achieved.

According to a second aspect of the invention, a device, in particular of the above-described kind, for coating material with resin and subsequently laying the material saturated with the resin onto a surface, may comprise a vessel for retaining the resin attached to the frame, the vessel having a slot sized and configured so that material is possible through the slot after being coated with resin retained in the vessel, a roller from which rolled material is unrolled and a tension adjustment mechanism for adjusting the tension of the unrolled material.

A core idea of the second aspect is the tension adjustment mechanism allowing for a simple and consistent regulation of the tension of the unrolled material such that unwanted folding and/or creasing of the material to be saturated with resin can be reduced or fully avoided.

The tension adjustment mechanism may comprise one, two or more moveable members, in particular spring members, and/or an actuating member, in particular for moving the one or more moveable members towards and/or away from the material to be saturated with resin (in particular towards and/or away from the rolled material to be unrolled). The spring member(s) are preferably leaf-spring member(s). The actuating member may be a rod (in general: elongated member) which may comprise an arresting portion for arresting the elongated member (rod) in different positions. In any event, a simple adjustment of the tension can be obtained.

At least one of the one or more moveable members may be rotationally and/or translationally moveable.

At least one of the one or more moveable members may contact a rolled portion of the material to be saturated with resin. In particular, at least one of the one or more moveable members may be pressed against a rolled portion of the material to be saturated with resin.

An arresting means for arresting the actuating member in at least two different positions may be provided. Thereby, the tension adjustment may be carried out in a well-defined and regulated manner.

The device may comprise one or more side wheels, e.g. at least two or at least three or at least four side wheels, preferably being provided on (only) one side of the device or on both sides. These side wheels allow placing the device on its side so that it can be easier to place and/or carry, e.g. in a (cargo) elevator, if necessary. This aspect of the invention is preferable combined with one or more of the other aspects (above or below). However, this aspect may be an independent aspect of the invention. Optionally, the one or more side wheels may be provided without the first and second roller being arranged on either side of the slot or behind the slot. Further optionally, the one or more side wheels may be provided without the tension adjustment mechanism for adjusting the tension of the unrolled material.

Conical centering cones may be provided which may center a roller core of the material roller, even if different material rollers with different roller cores are used. This aspect of the invention is preferable combined with one or more of the other aspects (above or below). However, this aspect may be an independent aspect of the invention. Optionally, the centering cones may be provided without the first and second roller being arranged on either side of the slot or behind the slot. Further optionally, the centering cones may be provided without the tension adjustment mechanism for adjusting the tension of the unrolled material.

According to another aspect of the invention, a method of applying a reinforcing material for waterproofing or roofing of a structure may comprise the steps of coating material with a liquid resin via a device of the above-described kind and of laying the material saturated with the resin on a surface or a subsurface of the structure via the device. The method may further comprise adjusting a width of the slot and/or adjusting a distance between the rollers, in particular by rotation (pivoting) of one or two of the rollers. The method may further comprise adjusting a tension of the unrolled material between a roller on which the material is rolled and a free end of the material.

According to another (independent) aspect of the invention, a use of the device for coating material with resin and subsequently laying the material saturated with the resin onto a surface, in particular a surface of a roof, plaza deck, park deck or other (flat, in particular upper and/or covering) surface, is proposed.

The device for coating material with resin and subsequently laying the material saturated with a resin onto a surface may be moveable and/or transportable. "Moveable" means in particular that the device comprises moving means such as one or more (e.g. at least two or at least three or at least four or more) wheels and/or continuous tracks (caterpillar tracks) and/or (ground-contacting) transportation rollers and/or one or more skids. In particular, the device is moveable during application of the material saturated with resin. Alternatively or in addition, the device may be transportable, meaning that there are one or more means such as one or more (e.g. at least two or at least three or at least four or more) wheels and/or continuous tracks (caterpillar tracks) and/or (ground-contacting) transportation rollers which allow to move the device to another location. Moving means and transportation means may be formed by the same or different structures.

First means (such as wheels etc.) may be provided for moving the device during application. Further, second means (such as wheels etc.) may be provided for moving the device for transportation, whereas an orientation of the device during application is preferably different to an orientation of the device during transportation. In particular, the second means may be provided at another side of the device than the first means, e.g. on a second side which defines, together with a first side, where the first means is provided, an angle of (at least approximately) 90°.

The roofing and/or waterproofing may include applying the material saturated with resin on a roof, plaza deck, park deck, or other (flat, in particular upper and/or covering) surface. Resins such as Sikalastic® 601, 621, 624 or 641 (in its composition at the filing date) may be used. Preferably, a polyurethane based resin may be used. Other polymeric resins may be used. Optionally, epoxy resins or polyester resins or other resins may be used.

The material to be saturated with the resin may be a fabric or a fleece or an (optionally porous) membrane.

The device may comprise a carriage which may be constructed of (e.g. rectangular) metal (in particular aluminium) components (tubes). This allows a low weight of the device. The resin vessel may be constructed of a metal (in particular aluminium or aluminium alloy), in particular polymer-coated. This eases a cleaning step. Optionally, all metal parts may be either aluminium or stainless steel which may eliminate the potential for rust developments. The slot adjustment mechanism and/or the distance adjustment mechanism and/or the tension adjustment mechanism and/or the first and second (bottom) rollers may be constructed so that they can be removed from the device and be replaced (without destroying a connection mechanism with the device, i.e. providing corresponding detaching mechanisms, for example comprising screws or snap-in mechanisms). Front wheels may be able to swivel (to enhance manoeuvrability) and/or may be locked (to facilitate straight-line material application). Rear (roller) wheels (in particular beneath the resin vessel) may provide a (near-) continuous bearing area to reduce concentrated loads on the substrate surface.

The tension adjustment mechanism may be configured to allow for independent variation of pressure applied to each end of the material roll (in order to prevent application of wrinkled material). The front-rear dimension of the device may be less than 48 inch (or less than 121.92 cm) to allow transport in typical commercial pick-up trucks and vans.

A resin delivery system may be provided, for example a pump system for pumping the resin from a larger container into the resin vessel. A multi-component resin mixer may be provided (in particular prior to pumping the resin from one container or several containers into the resin vessel). Rollers, squeegees, scrapers (or other apparatus) for spreading out the resin, preventing/reducing air entrapment and/or eliminate/reducing manual finishing may be provided.

The device may comprise a means for securing a roll of the material to be saturated with resin (e.g. fabric) and/or a vessel (in which the liquid resin may be placed) and/or an adjustment mechanism that may vary the width of a slot and may thereby control the thickness of saturated material and/or a resin shut-off mechanism that closes the slot when no material is applied and/or rollers on either side of the slot that may guide the saturated fabric onto the substrate surface and/or a wheeled carriage to which all components may be secured and/or a steering mechanism and/or a material roll tension adjustment mechanism. The device may be configured to be propelled manually but could also be motorised.

Amongst the advantages of the invention are very few moving parts, a low centre of gravity for stability, short and direct travel paths for the material to be saturated with resin, short distances from the rollers to the substrate surface to minimise air entrapment under the reinforcing material, easy cleaning with most surfaces in contact with the resin being made of non-stick materials, a strong and light weight carriage, a good manoeuvring performance to facilitate accurate material placement, the possibility to place the material moving either left-to-right or right-to-left, inset wheels allowing for direct overlap of adjacent membrane sheets, relatively fast material placement when compared to (full) manual application methods, a rather consistent material thickness, in particular when compared to (full) manual application methods.

The method of coating material with resin and subsequently laying the material saturated with the resin onto a surface may comprise the following steps: a (tubular) holder may be passed through the core of a roll of reinforcing material and may then be placed in mounting arms. The material may be pulled down between guide rollers and through the slot at a base of the receiving vessel, may then be passed between the first and second (bottom) rollers and may then be extended onto the substrate surface. The width of the slot opening may be adjusted to the desired material thickness. Liquid resin may be poured into the resin vessel to create a resin bath that surrounds the reinforcement material. The device (e.g. fleece saturator) may be pulled along the substrate surface and the saturated (fabric) material (membrane) may exit the saturator from between the first and second (bottom) rollers and may adhere to the substrate surface. Additional liquid resin and reinforcing fabric may be added as required. At least limited manual finishing of the placed material (membrane) by means of a roller may be performed in order to remove any air bubbles and/or spread out any excess resin. Additional adjustment of the slot width may be performed to achieve desired material (membrane) thickness.

All in all, the simplicity of the device (e.g. fleece saturator) minimises moving parts. Use of the opening adjustment mechanism to regulate the material (membrane) thickness may prevent uncontrolled resin leakage through the slot. A (direct) travel path of the reinforcing material (fabric) from the roll to the substrate surface may minimise deformation of the material (fabric). A rather low (minimal) distance from the underside of the bottom rollers to the substrate surface may minimise air entrapment underneath the material (membrane) and may minimise the need for manual finishing.

BRIEF DESCRIPTION OF THE DRAWINGS

In the following, preferred embodiments of the present invention are described with reference to the drawings. These show.

DETAILED DESCRIPTION OF THE EMBODIMENT

Figure 1:
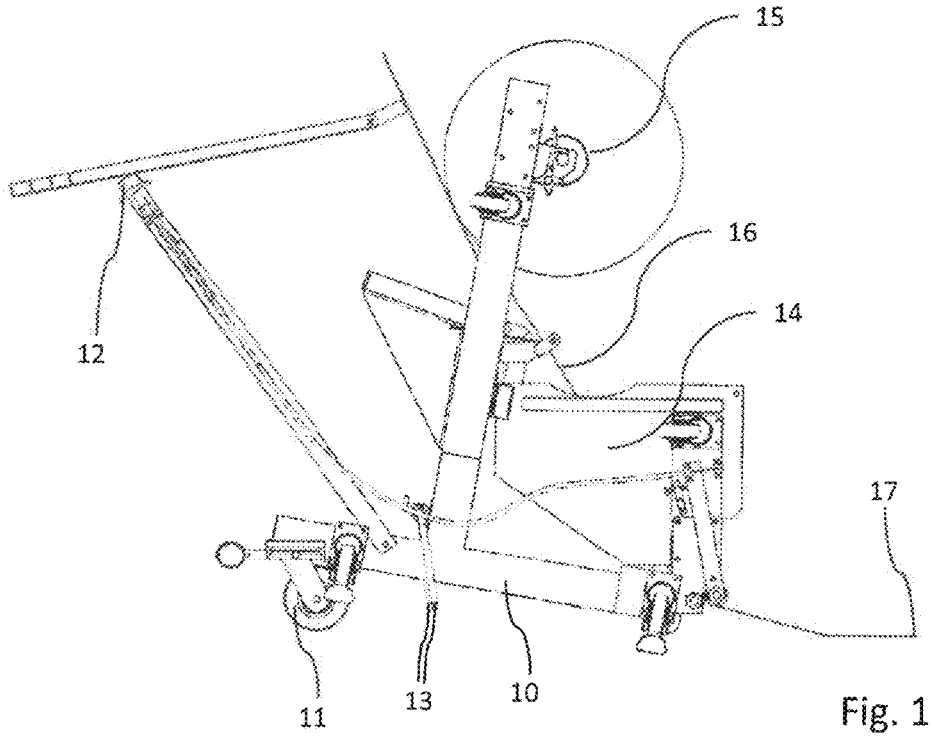
FIG. 1 A side view of a first exemplary embodiment of a device for coating a sheet of material and applying the sheet of material to a surface.
Figure 3:
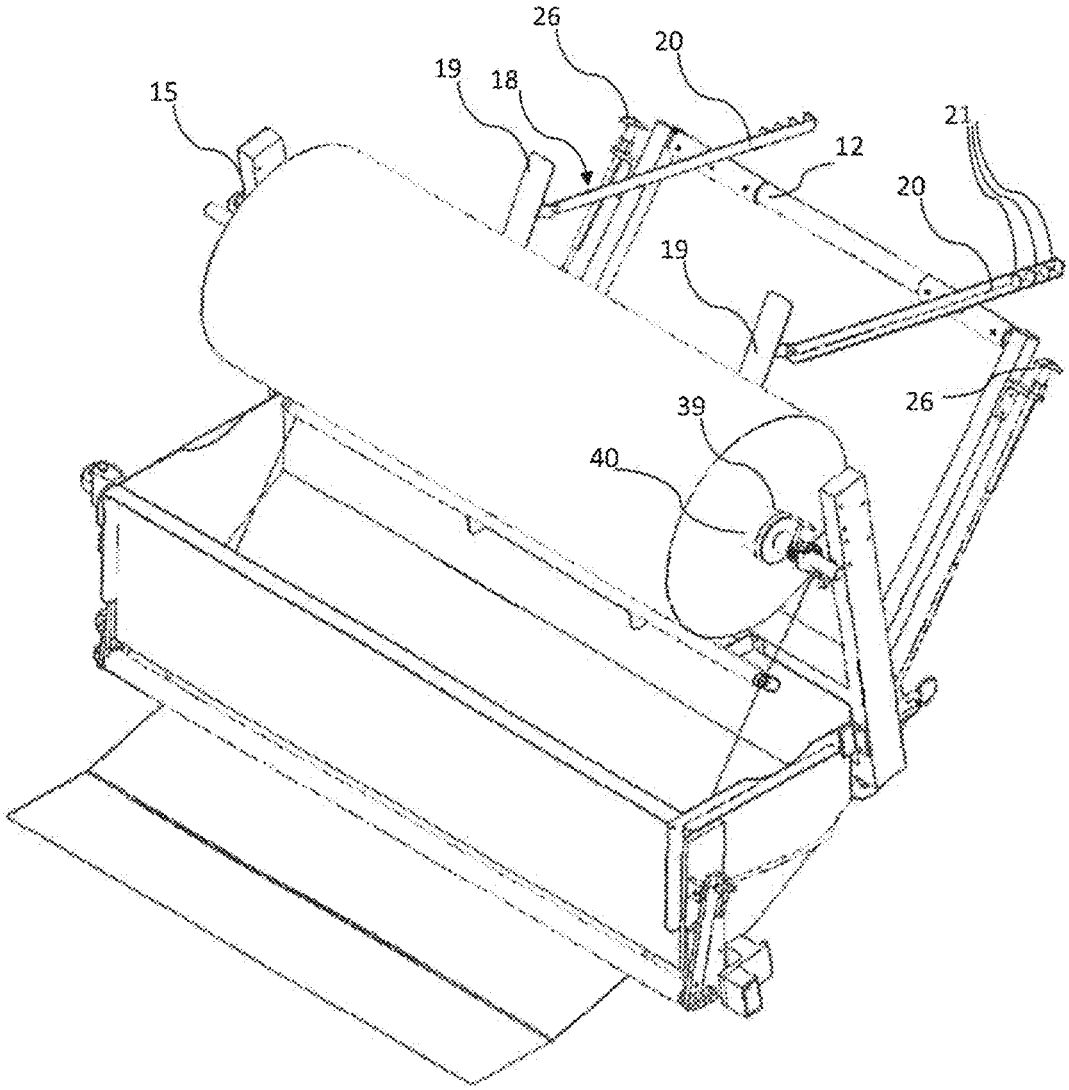
FIG. 3 A side perspective view of the device of FIG. 1.

FIG. 1 shows a first embodiment of a device for a coating material with resin and subsequently laying the material saturated with the resin onto a surface. The material may be applied onto a surface of a structure such as a roof, floor of a deck, or a subsurface of a structure. The device includes a frame 10 and wheels 11 so that the device is moveable along the surface for applying the coated material. A handle 12 (see also FIG. 3) is attached to the frame 10 (and may be moveable from a stowed position to an operative position). A user may grasp the handle 12 to push and/or pull the device and steer the device.

Pointers 13 may be positioned adjacent opposite sides of the frame 10. The pointers 13 may provide a visual indicator that helps the user steer the device to facilitate the laying of saturated material and to help overlay edges of immediately adjacent rows of laid material.

Figure 2:
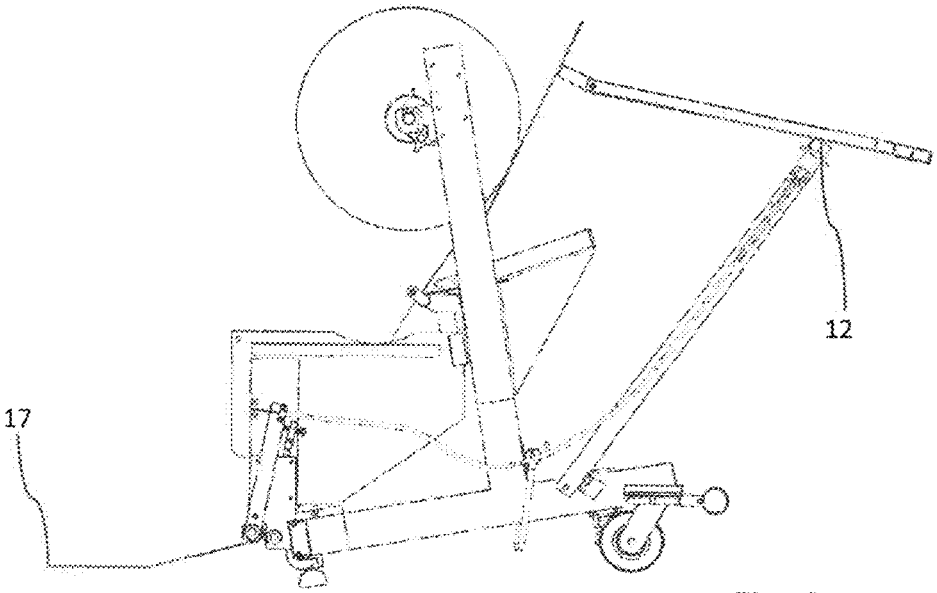
FIG. 2 A further side view of the embodiment of FIG. 1.

The frame 10 supports a resin vessel 14 that may contain a liquid resin. In addition, the frame 10 supports a material roller 15 (in general material holder) onto which material 16 to be saturated with resin is rolled. In FIGS. 1 and 2, a free end 17 of the material 16 is applied on the ground. Adjustable conical centering cones 39 may center a roller core 40 of the material roller 15, even if different material rollers with different roller cores 40 are used (see FIGS. 3 and 4). In order to saturate the material 16 with resin, it is moved through the vessel 14 filled with liquid resin. The material exits the vessel via slot 38 (see FIG. 8).

Figure 7:
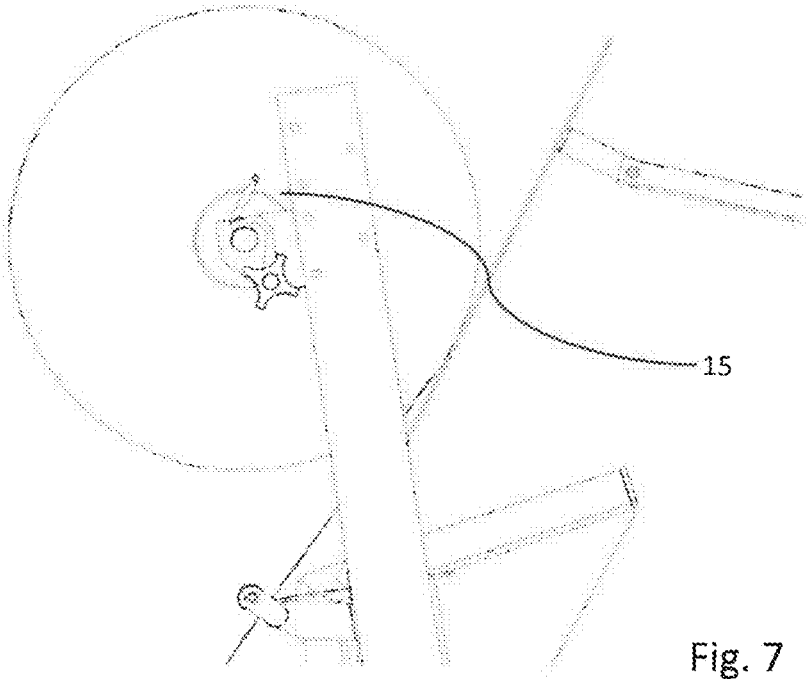
FIG. 7 A portion of a side view of the device of FIG. 1.

A tension adjustment mechanism 18 (see FIG. 3) comprises (a pair of pivotally) moveable members 19 which may come in pressed contact with the material on the material roll 15 (see also FIG. 7). The moveable members 19 may have an elongated plate-shape. The moveable members 19 can be moved by actuating members 20 so that they can be pressed against the roller 15, wherein such pressing force can be regulated by the actuating members 20. The actuating members 20 can be arrested in different positions via arresting means 21 which can be arrested in corresponding arresting means at the frame and/or the handle (not shown in the figures). The arresting means 21 may comprise on or more recess(es) and/or one or more projection(s).

Figure 4:
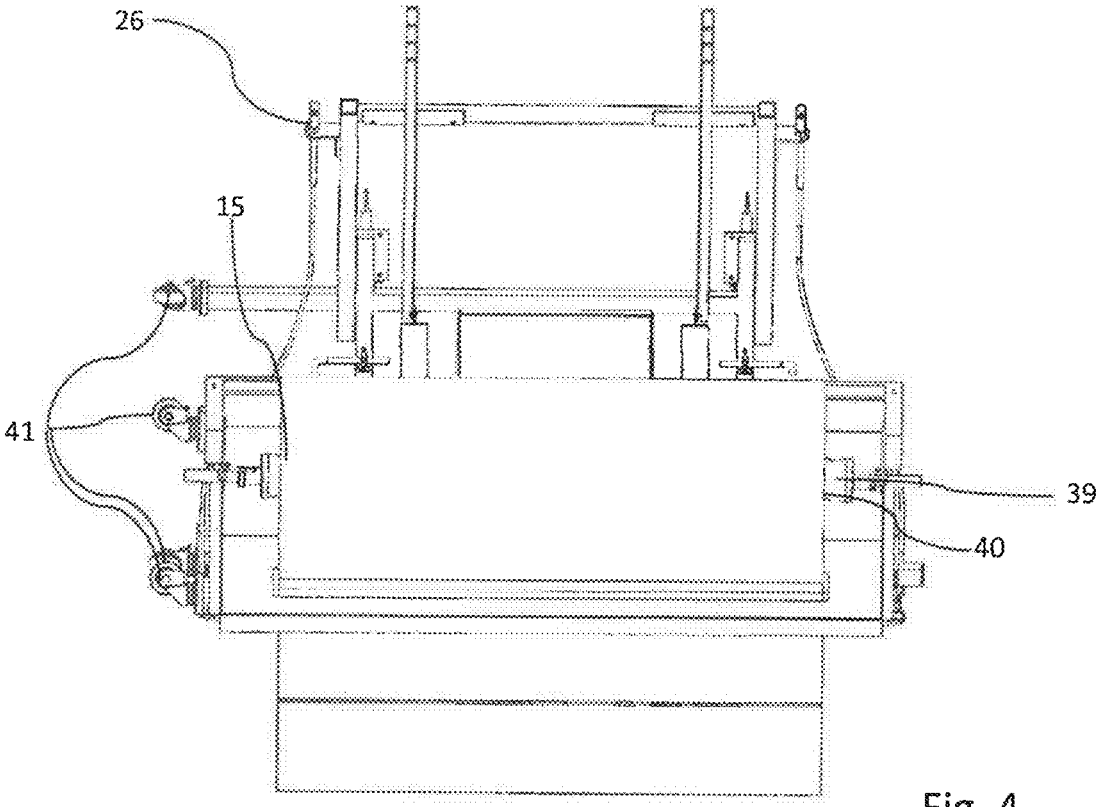
FIG. 4 A front view of the device of FIG. 1.

In particular FIG. 4 shows a plurality of side wheels 41. In general, one or more (e.g. at least two or at least three or at least four) side wheels 41 may be provided on (only) one side of the device or on both sides. These side wheels allow placing the device on its side so that it can be easier to place and/or carry, e.g. in a (cargo) elevator, if necessary.

Figure 5:
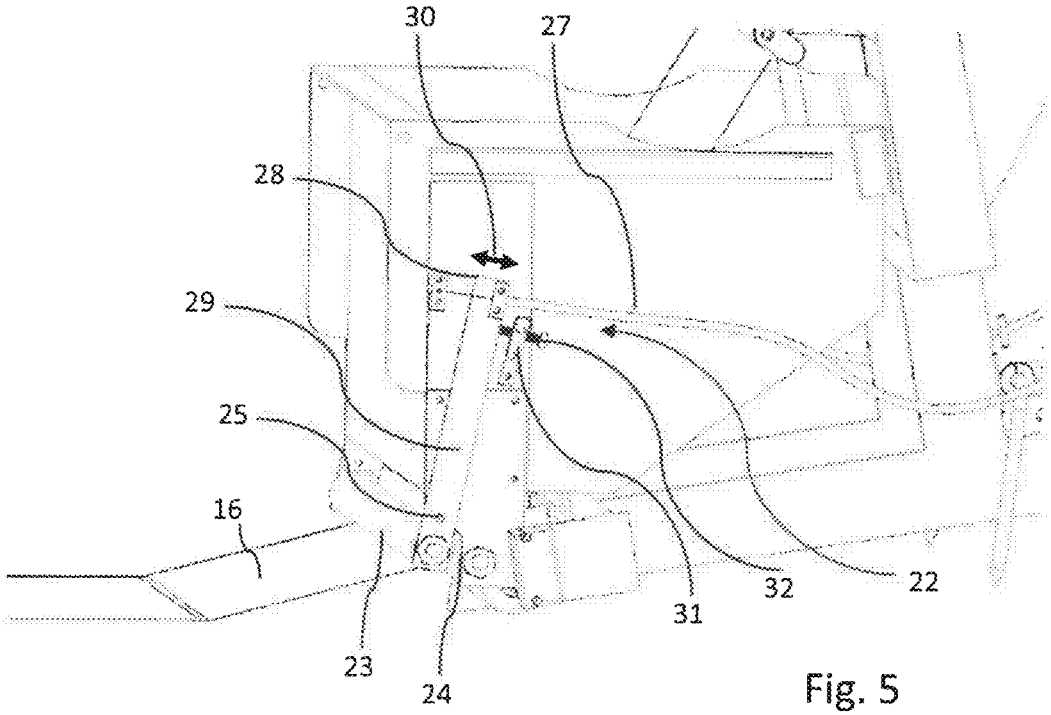
FIG. 5 A perspective view of a portion of the device of FIG. 1.
Figure 8:
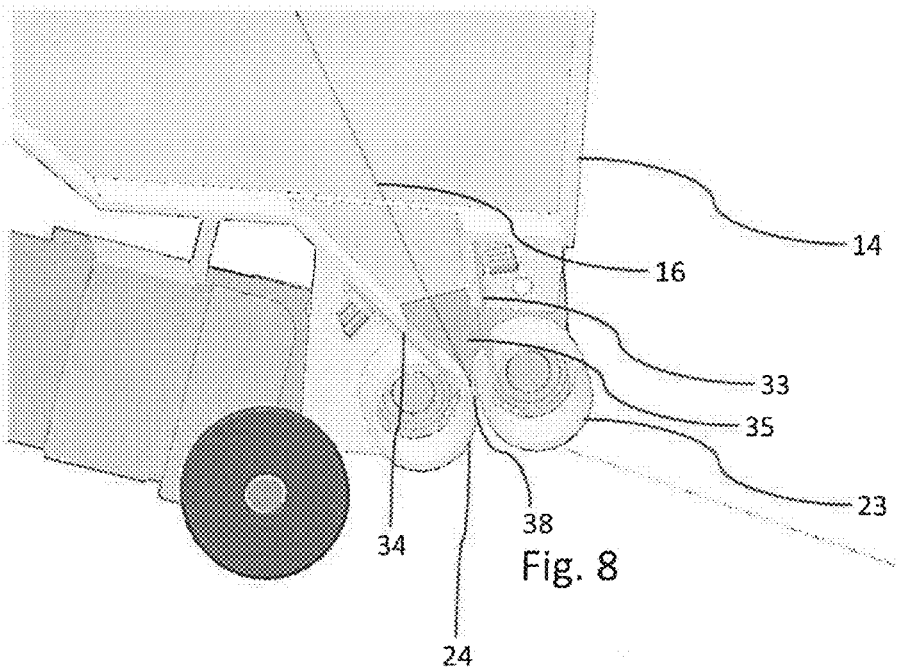
FIG. 8 A perspective cross-section of a portion of the device of FIG. 1.
Figure 9:
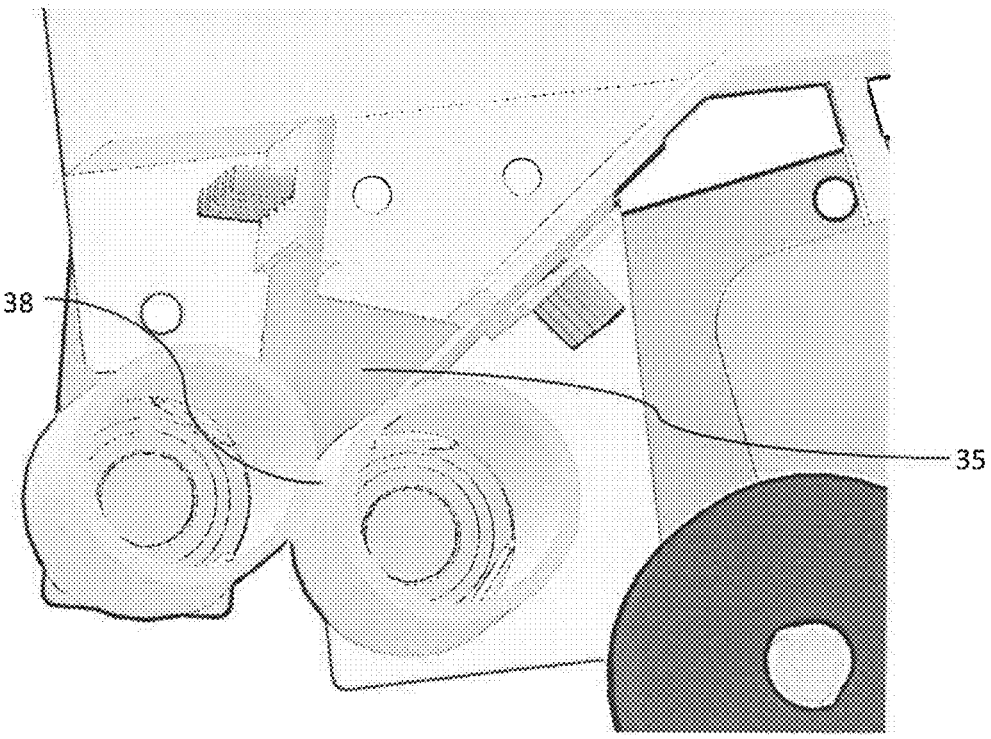
FIG. 9 A perspective cross-section of a portion of the device of FIG. 1.

FIGS. 5, 8 and 9 show details of a first 23 and second 24 rollers which are arranged at the bottom of the vessel 14 and which guide the material 16 onto the surface to be coated with the material 16.

A distance between the rollers and a width of the slot 38 can be regulated by a distance and/or slot adjusting mechanism 22. In order to adjust a distance between the rollers 23, 24, the first roller 23 can be pivoted (swivelled) around a rotation axis 25 (see FIG. 5). In order to pivot the first roller 23, a handle 26 (see for example FIG. 3) being connected with a cable 27 (see FIG. 5) is operated. Thereby, an end portion 28 of a supporting member 29, supporting the first roller 23 can be moved in the direction of an arrow 30. This movement may be assisted by one or more spring members (not shown in the figures). Via handle 26 a slot between the rollers 23, 24 may be adjusted.

Furthermore, FIG. 5 shows a closing mechanism 31, for closing a distance between the rolls 23 and 24. Precisely, the closing mechanism 31 comprises a screw 32 via which the supporting member 29 can be rotated so that the first roller 23 approaches the second roller 24.

As seen in FIG. 8, each of the first and second rollers 23 and 24 are in contact with a first vane 33 and a second vane 34, respectively. First vane 33 and second vane 34 function as guide members for guiding the material 16 in the direction of the rolls 23 and 24. Moreover, first vane 33 and second vane 34 seal the rollers 23, 24 with respect to the vessel 14. Moreover, a stopping member 35 is provided on either end portion of the rollers 23, 24 and is located partially between the rollers 23, 24 in order to stop flow of resin in a sideward direction.

Figure 6:
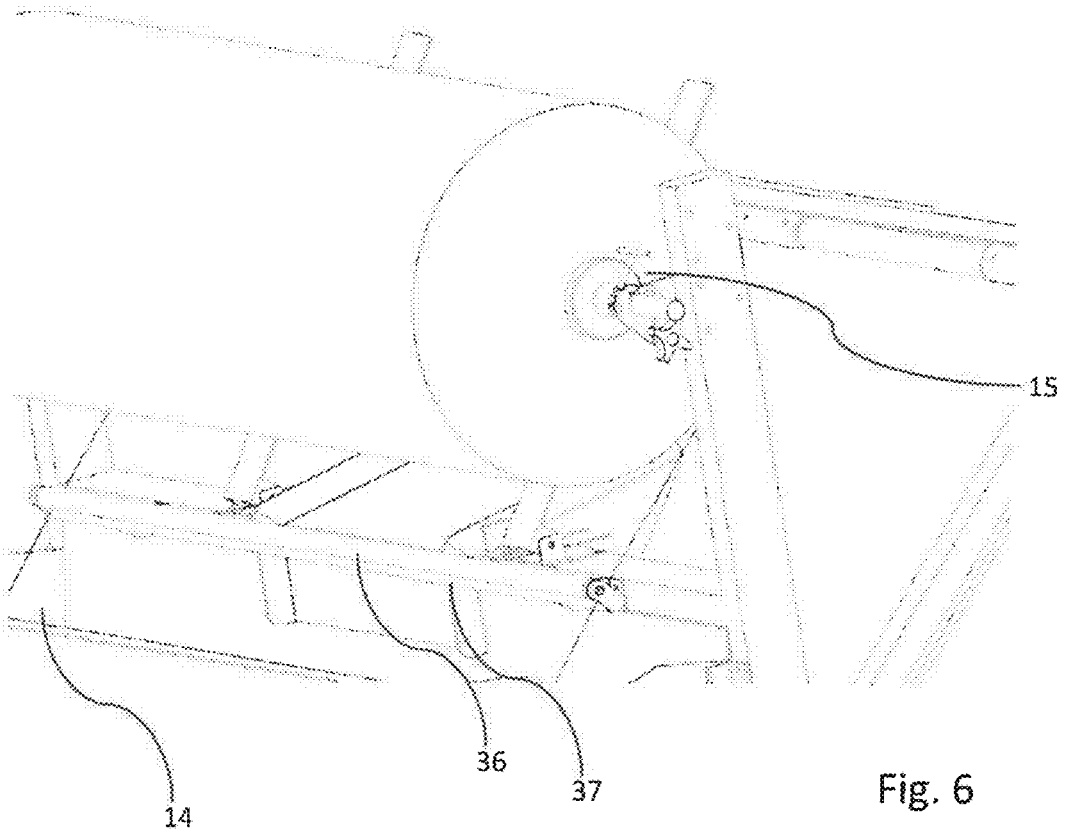
FIG. 6 A perspective view of another portion of the device of FIG. 1.

A third 36 and fourth 37 (upper) roller are arranged between the material roller 15 (see FIG. 6) and the vessel 14. These rollers 36, 37 may further reduce wrinkling of the material 16. These rollers further enhance the process of applying saturated material. In particular, the risk of movement ("sailing") of the fabric (when working under windy conditions) is reduced (to a great extent).

REFERENCE SIGNS

10 Frame
11 Wheel
12 Handle
13 Pointer
14 Vessel
15 Material roller
16 Material
17 Free End
18 Tension adjustment mechanism
19 Moveable member
20 Actuating member
21 Arresting means
22 Distance and/or slot adjustment mechanism
23 First roller

24 Second roller
25 Rotation axis
26 Handle (for adjusting a slot between the rollers 23, 24)
27 Cable
28 End portion
29 Supporting member
30 Arrow
31 Closing mechanism
32 Screw
33 First vane
34 Second vane
35 Stopping member
36 Third roller
37 Fourth roller
38 Slot
39 centering cone
40 roller core
41 side wheel

The invention claimed is:

1. A device for coating material with resin and subsequently laying the material saturated with the resin onto a surface, the device comprising:

a frame comprising an operator handle;

a vessel for retaining the resin, the vessel being supported by the frame and comprising a slot sized and configured so that the material is passable through the slot after being coated with resin retained in the vessel, and a first roller and a second roller being arranged adjacent to the slot; and an adjustment mechanism comprising a supporting member pivotally connected to the frame at a point of the supporting member between a first end of the supporting member that supports the first roller and a second end of the supporting member, an adjustment handle positioned adjacent to the operation handle, and a cable spanning from the second end and the adjustment handle such that moving the adjustment handle pulls or pushes the cable causing the supporting member to rotate about the point, thereby moving the first roller relative to the second roller to adjust a distance between the first roller and the second roller and adjust a width of the slot.

2. The device of claim 1, wherein a first guide member comprising a first lamella or a first vane or a first plate is adjacent to the first roller for (1) guiding the material saturated with the resin or (2) sealing the first roller with respect to a vessel main body to prevent resin from leaking.

3. The device of claim 2, wherein a second guide member comprising a second lamella or a second vane or a second plate is adjacent to the second roller for (1) guiding the material saturated with the resin or (2) sealing the second roller with respect to the vessel main body to prevent resin from leaking.

4. The device of claim 1, wherein at least one stopping member is arranged at least partially between the first and second rollers for stopping a sideward flow of resin between the first and second rollers.

5. The device of claim 1, wherein the first and second rollers comprise a metal component and a plastic component.

6. The device of claim 5, wherein the metal component comprises a core member, a tubular member or a cylindrical member, the metal component comprising steel and the plastic component comprises a polymer coating.

7. The device of claim 1, further comprising:

a material roller from which rolled material is unrolled; and a tension adjustment mechanism for adjusting the tension of the unrolled material.

8. The device of claim 7, further comprising conical centering cones for centering a roller core of the material roller.

9. The device of claim 7, wherein the tension adjustment mechanism comprises one or more movable members and an actuating member for moving the one or more movable members towards or away from the material to be saturated with resin, wherein at least one of the one or more movable members is rotationally movable, translationally movable, or both rotationally and translationally movable.

10. The device of claim 9, wherein at least one of the one or more movable members contacts a rolled portion of the material to be saturated with resin.

11. The device of claim 9, further comprising an arresting means for arresting the actuating member in at least two different positions.

12. The device of claim 9, wherein the one or more movable members are springs.

13. The device of claim 1, further comprising one or more side wheels being provided on only one side of the device or on both sides of the device.

14. A method of applying a reinforcing material for waterproofing or roofing of a structure comprising:

coating a material with a liquid resin via the device of claim 1; and laying the material saturated with the resin on a surface or a subsurface of the structure via the device.

15. The method of claim 14, further comprising:

adjusting the distance between the first and second rollers by rotation of the first roller about the point via the supporting member; and adjusting a tension of the unrolled material between a material roller on which the material is rolled and a free end of the material.

* * * * *